United States Patent [19]

Wangermann

[11] 4,200,275

[45] Apr. 29, 1980

[54] COLLATING MACHINE

[75] Inventor: Jochen Wangermann, Appen, Fed. Rep. of Germany

[73] Assignee: Gruner & Jahr AG & Co., Itzehoe, Fed. Rep. of Germany

[21] Appl. No.: 847,895

[22] Filed: Nov. 2, 1977

[51] Int. Cl.[2] ..... B42B 2/00

[52] U.S. Cl. ..... 270/53; 270/55

[58] Field of Search ..... 270/37, 53, 55, 57; 271/150

[56] References Cited

U.S. PATENT DOCUMENTS

| | | | |
|---|---|---|---|
| 3,459,420 | 8/1969 | Huntwork | 271/150 |
| 3,554,531 | 1/1971 | Heigl | 270/53 |
| 3,776,543 | 12/1973 | Edwards | 270/53 |
| 4,046,367 | 9/1977 | Merker | 270/55 |

FOREIGN PATENT DOCUMENTS

| | | | |
|---|---|---|---|
| 2007831 | 8/1971 | Fed. Rep. of Germany | 270/55 |

*Primary Examiner*—Clifford D. Crowder
*Assistant Examiner*—A. Heinz
*Attorney, Agent, or Firm*—Remy J. VanOphem

[57] ABSTRACT

The invention is a collating and stitching machine to arrange into informative and significant order a plurality of part-product or sheets. The machine has at least two rotating sheet delivery drums, the axis of rotation of which extend substantially perpendicularly to the conveying direction of an endless conveyor. The endless conveyor transports the folded sheets during the collating thereof with their folded backs extending transversely to the conveying direction and with the folded backs leading the direction of movement. The conveyor inserts the sheets one into the other. At least one stitching head is arranged in the return area of the endless conveyor to stitch the sheets together and thereby form a booklet, a magazine or the like.

7 Claims, 1 Drawing Figure

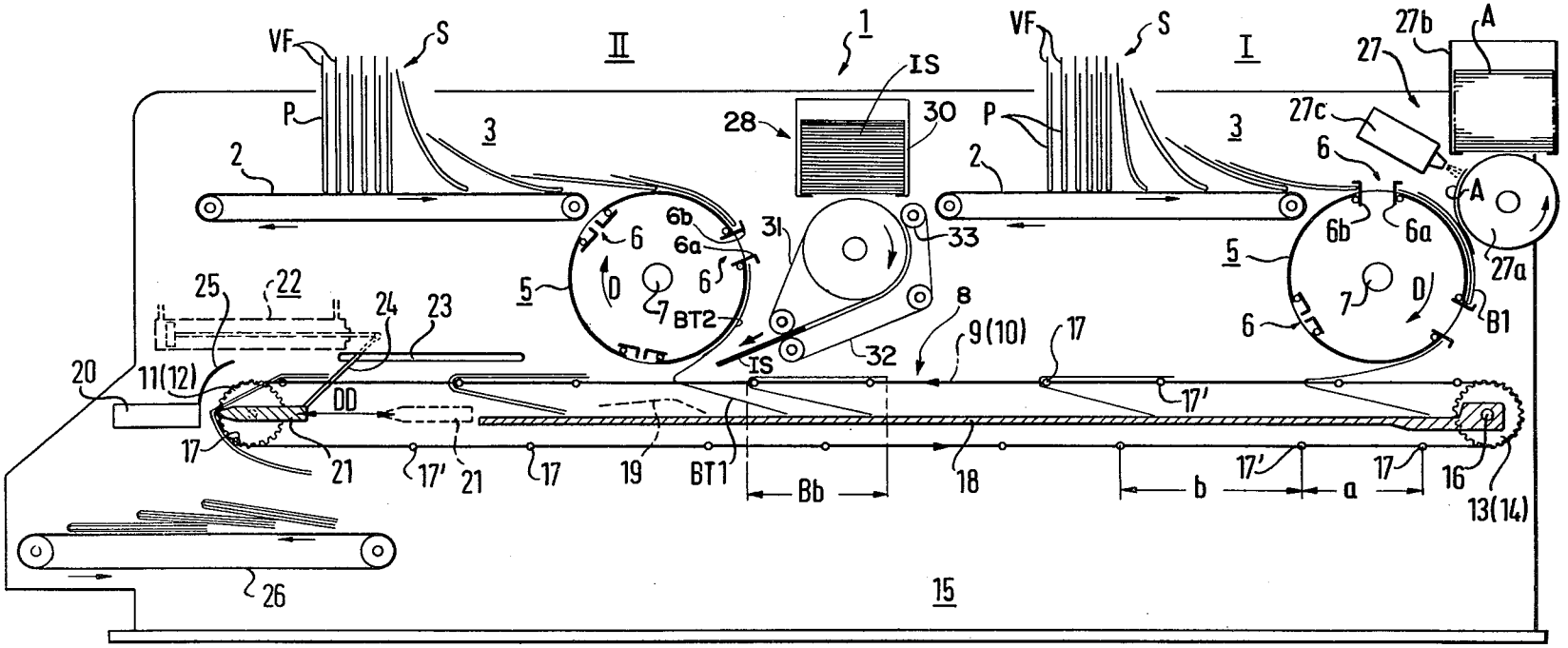
A
27b
27
27c
27a
B1
6
6a
6b
D
7
5
3
I
S
VF
P
2
IS
30
1
28
33
8
9(10)
32
31
TS
BT2
II
DD
22
23
24
25
11(12)
20
21
17
17'
18
19
BT1
Bb
a
b
16
13(14)
15
26

COLLATING MACHINE

BACKGROUND OF THE INVENTION

The invention refers to a collating and stitching machine with an endless conveyor conveying the sheets to be gathered towards a stitching station with at least one stitching head and with at least two rotating sheet delivery drums, which are arranged above and along the endless conveyor in spaced relationship.

Collators are known in the art, whereby an endless conveyor is used to form a collating chain. On the side of the chain or above the chain are arranged a number of rotating sheet delivery drums which take from vertically or horizontally stacked sheet staples signatures and sheets, respectively, open the sheets and let them slide onto the collating chain. Since the axis of the known rotating sheet delivery drums extend parallel to the conveying direction of the chain, there is a sudden variation of direction when the sheets are laid down onto the collating chain. The reason for the sudden variation in direction is because the conveying direction of the collating chain is perpendicular to the centrifugal force applied to the sheets by said rotating sheet delivery drums and perpendicular with respect to the gravitational force of the sheets. Normally, the individual sheet is taken from the associated feeder magazine, gripped by grippers and is accelerated by a first sheet delivery drum, which moves the sheet by use of the grippers against a stop, at which stop the grippers set the sheet free. The abutment at the stop causes a complete deceleration of the movement applied by the drum. Subsequent drums arranged beneath the first drum take the sheet, move it downwardly and open it. When opening grippers are used, a post or premargin is necessary; with the use of suction fingers, a closed head is necessary with the sheet. The drums arranged after the first drum let the sheet slide down onto the collating chain which takes the sheet by means of cams and varies its direction of movement by 90°. The multiple variations of the direction of movement necessary for the entire operation and the acceleration and decelerations associated therewith limits the possibility of increasing the capacity of the prior art collating chain. Any increase in speed beyond this limit creates great suceptability to trouble.

The collators with the sheet delivery drums arranged on the side of the chain require increased space. Independently of the arrangement of the sheet delivery drums, either on the side of the collating chain or above the chain, the known collators have the disadvantage that the trimmer normally located behind the collator has to be arranged perpendicular to the collating chain. Moreover, the prior art collators cannot be combined with inserting machines to form an integral system, rather, the inserting machine is normally arranged behind the trimmer leading to a further reorientation of the product flow by 90° due to the following reasons: through the cutting machine the product, e.g. a periodical, is transported with the closed back or fold leading the direction of movement. In the normal inserting machines the periodical, however, has to be arranged in such a manner that the closed back lies parallel to the direction of movement of the inserting machine so that the periodical can be opened by a knife moving into the periodical. Then, the insert is moved into the opened periodical while the direction of movement of the periodical and the insert are at a 90° angle. With the prior art arrangements used up to now, self-addressing of the printed periodicals is required immediately after the printing and production process, the periodical has, again, to be reoriented by 90°, since for self-addressing, the periodical has to be transported again with the closed back or fold leading the direction of movement.

SUMMARY OF THE INVENTION

It is the object of the present application to provide a collating and stitching machine with which fault free operation is insured and which requires smaller space.

This object is obtained by providing a collator which has delivery drums with axis of rotation extending substantially perpendicular to the conveying direction of the endless conveyor, in that the endless conveyor conveys the sheets during the collating thereof with the folded backs extending transversely to the conveying direction and with the folded backs leading the conveying direction. The sheets are inserted into one another and delivered to a stitching head which is mounted in the return area of the endless conveyor.

By arranging the rotating sheet delivery drums with the axis of rotation extending substantially perpendicular to the conveying direction of the endless conveyor, the sheets as taken from the staple storage are put onto the endless conveyor with a component of movement which has the same direction as the conveying direction. Further, substantially smaller floor space for the production chain of printing products is achieved by arranging the rotating sheet delivery drums above the endless conveyor. At the output end of the improved collator, the printed products are already in a proper position of orientation so they can be cut in the trimmer without further handling, i.e. the trimmer needs not to be arranged perpendicular to the collator as in prior art devices. Moreover, the improved collator offers the possibility to integrate the inserting machine with the collator so that finally inserted and stitched products can be transported to the trimmer after separating from a continuous stream formed at the output of the collator. It has to be stressed, that, with the integrating of one inserting machine or a plurality of inserting machines, an exact placing of the supplement or insert to be inserted between the sheets is possible, since the direction of movement of the sheets and inserts are substantially the same and the velocity of the insert is correspondingly higher only to allow for the insert operation. Thus, it is safely provided that the insert is inserted in such a manner that during the cutting of the stitched periodical by the trimmer, the insert does not come in the cutting area of the trimmer. Thus, the improved collator provides a product which presents itself to the inserting, trimming and self-addressing stations of the machine in the same oriented position as during the collating process, that is, with the folded or closed back leading the direction of movement. With the improved collator, the variation of direction of the sheets and stitched products during the production are limited to a minimum. Because of the higher production speed attainable with the proposed collator, a given production volume can be realized with a smaller number of collating lines.

BRIEF DESCRIPTION OF THE DRAWINGS

The drawing shows the preferred embodiment of the collator and stitching machine.

One embodiment of the collator and stitching machine shall now be described, while considering the drawing.

DESCRIPTION OF THE PREFERRED EMBODIMENT

FIG. 1 shows the collating machine with only two feeding stations I and II. The total number of feeding stations is adjusted according to the total product to be collated in a continuous operation. With the shown embodiment, each feeding station includes a conveyor belt 2. On each conveyor belt 2, a part-product S is laid down and oriented specifically to present itself to a delivery drum in the illustrated manner. With the shown embodiment, the part-products P have a premargin VF, i.e. a projecting sheet part, the importance of which will be discussed later. Each conveyor belt is associated with an orientation unit 3 which is adapted to transform the part-product S, the part-products of which are lying with the folded backs on the conveyor belt 2, into a continuous stream of partly overlying products. In the conveying direction, after each conveyor belt 2, a delivery or acceleration drum 5 is arranged, which is adapted to rotate in the direction of the arrow D. A pair of grippers 6 including a leading gripper 6*a* and a trailing gripper 6*b* are uniformly spaced about the periphery of the acceleration drum 5. The orientation unit 3 is not shown in detail in the figure in that these are well known in the art. The figure illustrates only that from a product brought into the feeding station I and II, respectively, individual sheets can be taken by the grippers 6.

Orientation units are well known in the art; for example, the product can be transformed into an endless stream with partly overlying products by the deliverer EA 32 of the company Dr. Ing. G. Schick, Bielefeld, Am Herrenkamp 10. Further, it is possible that from a magazine arranged above the collator, horizontally lying part-products are taken as is, for example, the case with the booklet deliverer BRA of the company Muller Martini AG, CH-4800 Zofingen. Further, it is conceivable that a continuous stream is directly fed to the collator by means of the Rotapal-System of the company FERAG AG, CH-4340 Hinwiel/Zurich. With all these known orientation units, it is important that the axis of rotation of the acceleration drums 5 extend horizontally and transversely or perpendicularly to the conveying direction of an endless conveyor 8 extending beneath the acceleration drums 5.

The endless conveyor includes two spaced chains 9 and 10, which are led over front chain wheels 11 and 12 and back chain wheels 13 and 14. While the back chain wheels are supported on a shaft 16 extending between the frame walls of the machine frame 15, the front chain wheels 11 and 12 are supported on shaft stubs arranged in the frame walls, respectively, so that between both the front wheels 11 and 12 a space is established, the importance of which is discussed below. A plurality of driver bars 17 and holding bars 17' are attached to the chains and extend therebetween. In the conveying direction of the chains 9 and 10, a smaller distance a between driver bar 17 and holding bar 17' is followed by a greater distance b between holding bar 17' and the next driver bar 17, this in turn, is again followed by a smaller bar distance a. The bar distance arrangement continues as described for the complete chain length. The conveying speed v8 is approximately twice the peripheral speed v5 of the acceleration drums 5. Between the front end of the chain conveyor 8 and the back end thereof, an elongated protection element 18 extends. With the shown embodiment, the protection element 18 has the form of a flat plate. It can also be provided with opening pockets 19 which are offset with respect to a vertical plane extending through the rotational axis 7 of all the sheet delivery drums 5 in the conveying direction of the chain conveyor 8. As indicated by the dashed lines in the drawing, the offset of these opening pockets increase in the conveying direction of the chain conveyor 8 towards their left-hand end in the figure. With respect to the configuration of the opening pockets, reference is made to the figure below the left acceleration drum 5, one opening pocket 19 is shown in dashed lines.

While the back end of the protection element 18 extends substantially up to the range of the back chain wheels 13 and 14, the forward end of the protection element (seen in the conveying direction of the chain conveyor 8) does not extend into the range of the front chain wheels 11 and 12. In the front return area of the chain conveyor 8 with the shown embodiment are arranged two stitching heads 20 side by side. These stitching heads stitch each product at the back thereof at two spaced positions. To achieve this result, the product has to be pressed, at the center thereof, by a counterpiece 21 into the stitching heads 20. The space between the front wheels 11 and 12 permits the counterpiece stitching heads to move between the wheels and press the product against the stitching heads in order to stitch the product. To allow the passing of the bars 17 and 17' past the stitching heads and to allow the ejection of the stitched products, the counterpiece 21 must be adapted to be moved away from the stitching heads to a sufficient extent. In the figure, the withdrawn position is shown in dashed lines and the to-and-fro movement, which preferably takes place substantially in the plane of the protection element 18 as shown by the double-headed arrow DD. The counterpiece 21 is movable by a piston-cylinder drive 22, which is supported on the machine frame 15 and is connected to the counterpiece 21 by means of a bar structure 24, the latter passing through a corresponding slot 23. Further, a guiding plate 25 is associated to the stitching heads 20 as shown in the figure.

Beneath the stitching heads, a second conveyor belt 26 is arranged onto which the stitched products fall. The conveyor belt 26 transports the products to an automatic trimmer designed to trim three sides of the product as 3-cutter (not shown). In the figure, a bonding or gluing device 27 is associated with the feeding station I. With the gluing device, one can glue in a rotative manner a post-card, label or the like onto the sheets B1 moved by the acceleration drum 5. With the shown embodiment, the rotative gluing device 27 includes a gluing roll 27*a*, which moves labels A stored in a magazine 27*b* towards the acceleration drum 5, after they have been withdrawn from the magazine by means of a conventional suction/gripper combination (not shown). The withdrawn label A is moved past a fixed spray head 27*c*, which applies glue to the label. Commercially available spray heads distributed under the mark DYNAPPLY 45c by LTI Corporation can be used to apply the glue. The label A on which glue had been applied by the spray head 27*c* is rolled onto the sheet B1 moved by the acceleration drum 5 and is held thereon by the glue. Simultaneously, the grippers open so that the label can be moved by the sheet B1 held by the acceleration drum 5.

An insert machine 28 which is shown in the figure schematically by the arrow 28, is associated with the acceleration drum 5 of the feeding station II. Thus, the inserting machine can also be integrated with the collator. With the conventional inserting machines, the loose inserts are injected into the product being transported transversely to the injection direction. The product is opened by a knife to permit the insert to be injected. A commercially available machine such as, for example, the inserting machine 227 by Muller Martini AG, CH-4800 Zofingen is used. The loose inserts IS are held in a magazine 30 and are withdrawn therefrom by suction or gripping means (not shown) and are fed between conveying belts 31 and 32 supported on rollers 33 in such a manner that they are shot into the up-folded product, e.g. into the up-folded product having the folded portions BT2 and BT1. With the collator according to the present invention, however, the inserts can be injected into the sheets opened by the acceleration drum 5, while the direction of movement of the sheets and the inserts, respectively, is the same. Naturally, the injection speed of the insert must be greater than the individual product sheet speed so that the insert can be injected regardless of the rate of movement of the sheet. As for the injection mechanism itself, the mechanism of the inserting machine 227 described above can be used with the present invention.

Normally, the prior art inserting machines are arranged after the automatic trimmer, so that the inserting machine inserts the loose insert anywhere in the product being already stitched and cut. With the arrangement of the inserting machine after the automatic trimmer, a predetermined insertion with respect to a given page is not possible. From the above description of the present invention, however, a predetermined insertion at any given page can be easily accomplished.

Operation

The part-product S on the conveyor belt 2 is transformed by the orientation unit 3 in a continuous stream of partly over-lapping products (scaled stream). With the feeding station II a part-product is just contacting with its back the peripheral surface of the acceleration drum 5. A further part-product is taken at its back or folded edge by a trailing gripper 6*b*. Upon further rotation of the acceleration drum, the leading gripper 6*a* of the gripper pair shown in the left upper section of drum 5 will grip the pre-margin VF of the part-product already held on its back edge, while the trailing gripper 6*b* of this gripper pair will guide the not yet gripped back folded edge of the next incoming part-product. This state of operation is shown with the acceleration drum 5 of the feeding station I.

Upon further rotation of the acceleration drum 5, the centrifugal forces and the force of gravity acting on the part-product will open the radially outward lying portion BT1 of the sheet, which part does not have a pre-margin. This loose sheet part is hindered by the protection element 18 from further opening in the direction towards the lower end of the chains 9 and 10. With the opening of the part-product, a driver bar 17 is moved into position by the chains 9 and 10 so that the driver bar 17 travels between the opened sheet. When the back or folded edge of the part-product which is held by the trailing gripper 6*b* has reached a predetermined position of its rotational movement induced by the acceleration drum 5, which is nearest to the chain conveyor 8, the gripper 6*b* opens, while the gripper 6*a* holding the pre-margin is still closed. After the driver bar 17 has entered into the opened part-product to a sufficient extent, the leading gripper 6*a* opens also and lets the other sheet portion BT2 fall down onto the chain conveyor 8. The space between the driver bar 17 contacting the back of the part-product from the inside of the product and the following holding bar 17′ corresponds to the space a and is selected so that the free end area of the sheet part BT2 held by the gripper at the post-margin falls down on the holding bar 17′ following at a distance a. The loose sheet portion BT1 lies beneath the level of the holding bar 17′. The distance a preferably corresponds to substantially $\frac{2}{3}$ of the sheet width Bb. The distance a can also be varied as long as a safe support of the sheet part BT2 is provided.

Further guidance is provided by the contact of the sheet portion BT1 with the protection element 18. Since the speed V8 of the chain conveyor 8 is approximately twice that of the peripheral speed V5 of the acceleration drum 5, the feeding of the next part-product onto the chain within the intermediate space of the length b is possible. The part-products being laid down in the feeding station I onto the bars 17 and 17′ are thus inserted into the part-products laid down in the feeding station II to achieve a collating operation. Although two feeding stations are shown only, it should be well understood that normally more than two feeding stations are provided. When the collators part-products approaches the stitching heads 20, the counterpiece 21 being in its position shown in dashed lines, enters into the middle of the product and presses (in that moment in which the leading support bar 17 supporting the back has just passed the position of the stationary stitching heads,) the product to be stitched against the stitched heads, which then perform the stitching operation. The timing is such that the counterpiece 21 picks up the product as the driver bar passes the stitching heads and returns towards the back of the conveyor 8 after the product is stitched.

Before the trailing holding bar 17′ which holds the upper sheet part BT2 reaches the stitching heads 20, the counterpiece 21 must have moved back towards the protection element 18, since without doing so it would hinder the passing of the trailing holder bar 17′. The finished and stitched product or periodical drips onto a transport belt 26 and is led to the automatic trimmer.

About the operation of the rotative gluing unit 27, nothing has to be stated in detail here. It should be mentioned, however, that the special manner in which the part-products are opened, while the sheet part BT2 is held, permitting loose inserts to be exactly inserted with respect to any page. Thus, it is possible to associate the inserts to certain editorial articles or certain advertisement. Due to the further manner of transporting the products, that is, with horizontally extending backs, the insert cannot drop from the bundle of the already gathered part-products. During the falling-down of the stitched products onto the conveying belt 26 it is also impossible for the inserts to leave the stitched product. Further, it has to be understood that it is not necessary that the part-product sheet has to be fed in the main direction of the operation which is determined by the endless conveyor as it is schematically shown. It is rather possible that the sheet which has already been transformed into a continuous stream of partly overlapping part-products can be led into the machine by a curve unit. The question of the feeding of the part-products to be collated and stitched will depend on the individual circumstances under which the part-product sheets are transported from the part-product store or magazine, respectively, to the collator. This question is totally independent, however, with the floor space needed for the collator stitcher itself. Besides gripper feeders, it is also possible to use suction feeders. The improved collator has a capacity, which has not yet been reached up to now with any known prior art collator since it can be operated with an output of more than 20,000 stitched copies per hour.

The counterpiece 21 can also be of a multi-part configuration, with which to each stitching head a separate counterpiece is associated; the separate counterpieces are moved synchronously to accomplish the same function.

Further, there is the possibility that the protection element 18 can still be elongated in the direction towards the stitching heads 20, if the stitching heads 20, the counterpiece 21 and the protection element 18 are relatively arranged with respect to each other in such a manner that one or a plurality of counterpieces can move beneath the forward end of the protection element.

The specific arrangement is limitless. What is important, however, is that in the area in front of the protection element 18, there remains sufficient space to enable the loose sheet portions BT1 of each gathered copy to swing downwardly to such an extent that the counterpiece or the counterpieces can move into the opened product. Further, the free space has to allow unhindered dropping of the stitched copy. Instead of moving the counterpiece beneath the protection element, it is further possible to withdraw the counterpiece or the counterpieces in correspondingly arranged recesses in the front edge of the protection element.

What is claimed is:

1. A collating machine for gathering a plurality of folded sheet product into a complete product, each of said plurality of product being folded into folded portions, said collating machine comprising:

a frame;

conveying means mounted to said frame for carrying said folded sheet product in only one predetermined conveying direction, said conveying means having two continuous drive elements mounted to said frame and a forward turn-round end, said drive elements moving in spaced drive planes, respectively;

a plurality of driver bars spaced between said two continuous drive elements, said plurality of driver bars extending perpendicular to said conveying direction and perpendicular to said spaced drive planes of said continuous drive elements;

means for mounting said two continuous drive elements to said frame;

means for stitching said complete product mounted adjacent to said forward turn-round end of said conveying means, said stitching means further being mounted transverse to said spaced drive planes for stitching said complete product in the conveying direction of both drive elements, said stitching means further comprising a reciprocally movable counter-piece member located adjacent to said stitching means such that the driver bars may pass between said counter-piece member and said stitching means, said counter-piece member further being movable into said folded sheet product to cause said folded sheet product to move towards said stitching means;

means for reciprocally moving said counter-piece member with respect to the drive elements and drive bars, said moving means located adjacent said frame for cooperation therewith;

first means for delivering a plurality of said folded sheet product to said driver bars, said first delivery means mounted above said conveying means and having an axis of orientation extending substantially horizontal and perpendicular to said conveying direction, such that said folded sheet product is deposited on said driver bars with the fold leading, while said folded sheet product surrounds a respective driver bar; and at least one additional means for delivering a plurality of said folded sheet product to said driver bars, said at least one additional delivery means mounted above said conveying means, each of said at least one additional delivery means having an axis of orientation extending substantially horizontal and perpendicular to said conveying direction, such that said folded sheet product is deposited on the folded sheet product delivered by said first delivery means in timed relationship to said first delivery means, said folded sheet product of said at least one additional delivering means being deposited on said folded sheet product of said first delivery means with the fold leading, while said folded product surrounds the product previously delivered by said first delivery means, such that as said first and at least one additional delivery means deliver said folded sheet products, said conveying means gathers said sheet product into said complete product, which is stitched by said means for stitching.

2. A collating machine as claimed in claim 1 wherein said first means for delivering said plurality of said folded sheet product further comprises means for gripping each of said plurality of product, said gripping means mounted to said first delivery means and adapted to grip said folded sheet product at its fold and by one of said folded portions.

3. The collating machine as claimed in claim 1 further comprising:

a container having labels mounted proximate said first delivery means;

a third delivery means interposed said container and said first delivery means; said third delivery means having an axis of orientation extending substantially perpendicular to said conveying means and further extending substantially parallel to said axis of orientation of said first delivery means; and means for applying a bonding agent to said label mounted in spaced relationship to said third delivery means, such that a label stored in the container is delivered by said third delivery means to said first delivery means and a bonding agent is applied during the delivery process.

4. The collating machine as claimed in claim 1 further comprising a means for inserting a loose insert into the centerfold of any of said plurality of folded sheet product, said inserting means located in spaced and timed relationship to said delivery means for predetermined cooperation therewith.

5. The collating machine as claimed in claim 1 wherein said conveying means further comprises a plurality of holding bars spaced between said two drive elements, each of said plurality of holding bars being alternatively spaced at a predetermined distance to each of said plurality of driver bars, said plurality of holding bars further extending perpendicular to said conveying direction between said two continuous drive elements, said distance being determined by the length of the folded portion of said folded product to be supported by a driver bar and a holding bar following said driver bar.

6. The collating machine as claimed in claim 1 wherein said conveying means further comprises a protection element mounted to said frame between the path of movement of said driver bars and adjacent said stitching means; and means for mounting said protection element to said frame in such a manner that said counter piece member may perform its movement in an unhindered manner.

7. The collating machine as claimed in claim 1 further comprising means for orienting mounted in proximate relationship to said first and at least one additional delivery means, said orienting means adapted to orient said folded sheet product such that the individual sheets are oriented to said first and at least one additional delivery means with its fold leading.

* * * * *